US008910346B1

(12) United States Patent
Schafer

(10) Patent No.: US 8,910,346 B1
(45) Date of Patent: Dec. 16, 2014

(54) DEVICE FOR REPAIRING HINGE AREA OF A DOOR

(71) Applicant: Bryan W. Schafer, Lafayette, IN (US)

(72) Inventor: Bryan W. Schafer, Lafayette, IN (US)

( * ) Notice: Subject to any disclaimer, the term of this patent is extended or adjusted under 35 U.S.C. 154(b) by 0 days.

(21) Appl. No.: 13/917,679

(22) Filed: Jun. 14, 2013

(51) Int. Cl.
*E05D 5/00* (2006.01)
*E05D 7/00* (2006.01)

(52) U.S. Cl.
CPC ..... *E05D 7/00* (2013.01)
USPC ..... 16/382; 16/247; 16/387

(58) Field of Classification Search
CPC ..... E05D 5/02; E05D 5/0215; E05D 5/06; E05D 5/065
USPC ..... 16/254, 247, 240, 382, 387; 248/274.1, 248/276.1, 178.1, 541
See application file for complete search history.

(56) References Cited

U.S. PATENT DOCUMENTS

| | | | | | |
|---|---|---|---|---|---|
| 1,323,757 | A | * | 12/1919 | Gogay | 49/400 |
| 3,229,323 | A | * | 1/1966 | Hensgen | 16/247 |
| 3,263,368 | A | * | 8/1966 | Hildum et al. | 49/382 |
| 4,118,827 | A | * | 10/1978 | Yamamoto | 16/252 |
| 4,304,027 | A | * | 12/1981 | Di Fazio | 16/249 |
| 4,411,045 | A | * | 10/1983 | Rock et al. | 16/243 |
| 4,438,597 | A | * | 3/1984 | Maggart | 49/501 |
| 4,553,286 | A | * | 11/1985 | Schwarz, II | 16/382 |
| 4,825,509 | A | * | 5/1989 | Mitchell et al. | 16/382 |
| 2007/0028420 | A1 | * | 2/2007 | Lueffe et al. | 16/382 |

OTHER PUBLICATIONS

Armor Concepts—Security That Works—Replacement Hinge Shields—Satin Nickel—http://armorconcepts.com/dt_catalog/replacement-hinge-shields-satin-nickel/—Apr. 17, 2013.
Door Latch Plates—Grainger Industrial Supply—http://www.grainer.com/Grainger/door-push-and-pull-plates/supplies/hardware/ecatalog/ . . . Apr. 17, 2013.
EZ Armor Combo Set—White—http://armorconcepts.com/dt_catalog/ez-armor-combo-set/—Apr. 17, 2013.
Grainger—BATTALION Door Reinforcer, H 12 × L 5 In—Door Push and Pull Plates—2MDG8/2M . . . —http://www.grainger.com/Grainger/BATTALION-Door-Reinforce-2MDG8?cm_sp=IO-_- . . . —Apr. 17, 2013.
Grainger—Door Jamb Armor Door Jam Armor Security Kit—http://www.grainger.com/Grainger/DOOR-JAMB-ARMOR-Door-Jam-Armor-Security-Ki . . . —Apr. 17, 2013.
Grainger—FIX-A-JAMB Doorjamb Repair, Interior—Door Protectors—2GTC7/FAJ-INT-10000—GR . . . —http://www.grainger.com/Grainger/FIXAJAMB-Doorjamb-Repair-2GTC7?Pid=search—Apr. 17, 2013.
Grainger—FIX-A-JAMB Fix-A-Jamb Door Repair and Reinforcement—http://www.grainger.com/Grainger/FIXAJAMB-Door-Jamb-Repair-Kit-6VKF3?cm_sp=1 . . . —Apr. 17, 2013.
Security—Door & Door Jamb Protection—Custom solutions that take cost out of Managing Inventory—grainger.com/keepstock—1-800-Grainger 3073.

* cited by examiner

*Primary Examiner* — Emily Morgan
(74) *Attorney, Agent, or Firm* — Woodard, Emhardt, Moriarty, McNett & Henry LLP

(57) ABSTRACT

A kit for repairing a damaged hinge portion of a door. A U-shaped bracket is mounted to the door. A mounting plate is attached to the bracket. A hinge is mounted to the mounting plate and is flush with the bracket.

4 Claims, 4 Drawing Sheets

DEVICE FOR REPAIRING HINGE AREA OF A DOOR

BACKGROUND OF THE INVENTION

1. Field of the Invention

The present invention relates generally to the field of hinges for mounting to and between a door and door jamb.

2. Description of the Prior Art

Repeated opening and closing of a door particularly in a public building, may result in eventual loosening of the hinge screws that extend into the door. In many cases, the doors cost upwards to $5000. Repeated tightening of the hinge mounting screws may result in an enlargement of the screw holes thereby eventually making it impossible to attach the hinge in the same location on the door which corresponds with the hinge location on the door jamb. Disclosed is a kit to avoid this problem by providing alternate means for mounting the hinge to the door in the same location as previously utilized. The kit employs a bracket that extends over the damaged portion of the door edge. The bracket is attached to the door and has a mounting plate attached directly to the hinge.

A variety of brackets have been used with doors particularly to strengthen the doors against forced entry. For example, metal walls may be attached to the door jamb and the door edge thereby reinforcing and controlling any gaps that exist between the door jamb and door to limit the forced entry of a tool there between. Likewise, a number of different types of protection plates provided across the width of the door as well as around the dead bolt, dead bolt receiving plate, and around any lock provided on the door handle to provide strengthening of the door. Another approach is to provide a metal hinge shield that extends over each hinge plate of a hinge limiting access to the hinge.

The device disclosed herein may quickly be mounted to the damaged hinge area of a door thereby salvaging the door and limiting the instances where the door must be discarded. The device has a U-shaped bracket that is mounted directly to the door. A hinge mounting plate is positioned within a recess of the door and is fixedly mounted to the U-shaped bracket. The hinge is then mounted directly to the mounting plate with spacers provided to ensure the outwardly facing surface of the hinge plate is flush with the outwardly facing surface of the U-shaped bracket.

SUMMARY OF THE INVENTION

A device for repairing a hinge area of a door. A u-shaped bracket is mountable to the damaged hinge area of a door and positioned between the edge of the door and the door jamb when the door is mounted to the door jamb. A hinge is mounted to a mounting wall attached to the bracket. The bracket has a cut-out portion into which the hinge is positioned to be flush with the bracket.

It is an object of the present invention to provide a new and improved device for repairing a damaged hinge area of a door.

A further object of the present invention is to provide a kit to repair the damaged hinge area of a door.

Related objects and advantages of the present invention will be apparent from the following description.

DESCRIPTION OF THE PREFERRED EMBODIMENT

Figure 1:
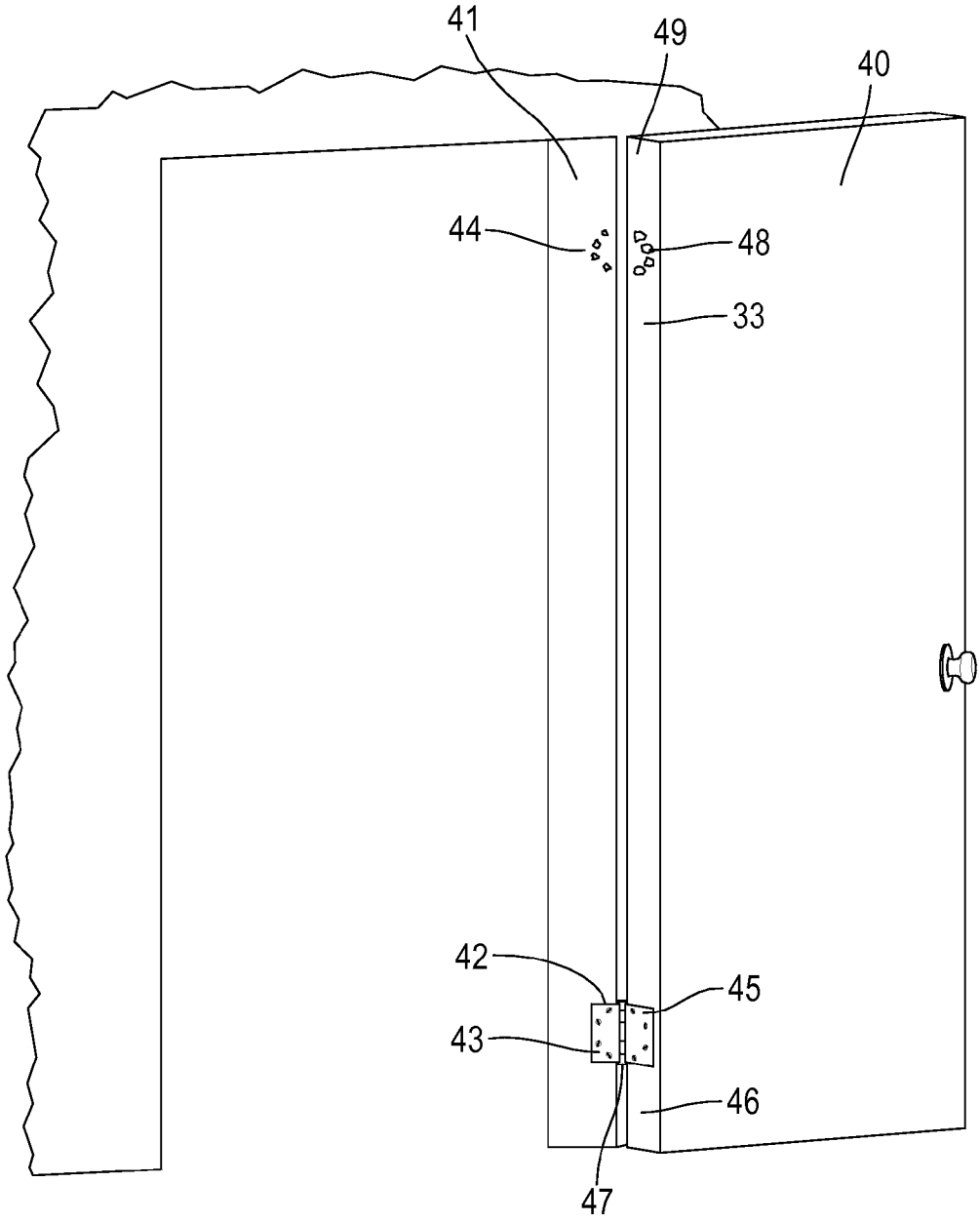
FIG. 1 is a perspective view of a door mounted to a door jamb having a damaged hinge area.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a door 40 pivotally mounted by conventional hinges to a door jamb 41. The bottom hinge 42 has a first hinge plate 43 fixedly mounted to the edge 44 of the door jamb by conventional fastening devices, such as screws. A second hinge plate 45 is fixedly mounted to edge 46 of door 40 also by conventional fastening devices such as screws. The two plates are hingedly connected together by a conventional hinge connection 47.

The top hinge is shown as missing from the door and door jamb of FIG. 1 since the fastening devices have become disengaged from the edge 46 of the door. In FIG. 1, the screw holes 48 are shown as being enlarged thereby preventing attaching of the hinge plate to the door. Repeated opening and closing and slamming of a door particularly in a public building, may result in the eventual loosening of the screws attaching the hinged plate to the door. Repeated retightening of the screws eventually results in the material forming the screw holes to deteriorate. As a result, eventually the screws are no longer effective to hold the hinge plate to the door. In many cases, the door is then discarded.

Figure 2:
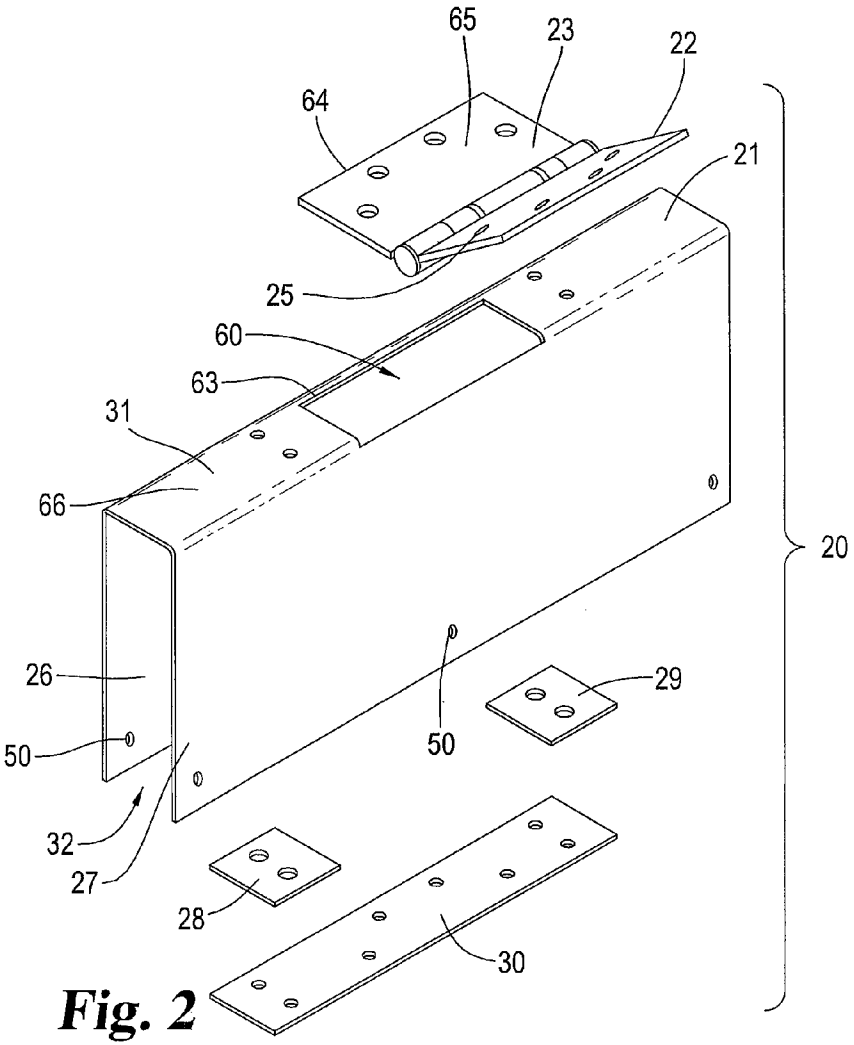
FIG. 2 is an exploded view of the kit used to repair the damaged hinge portion of the door.
Figure 3:
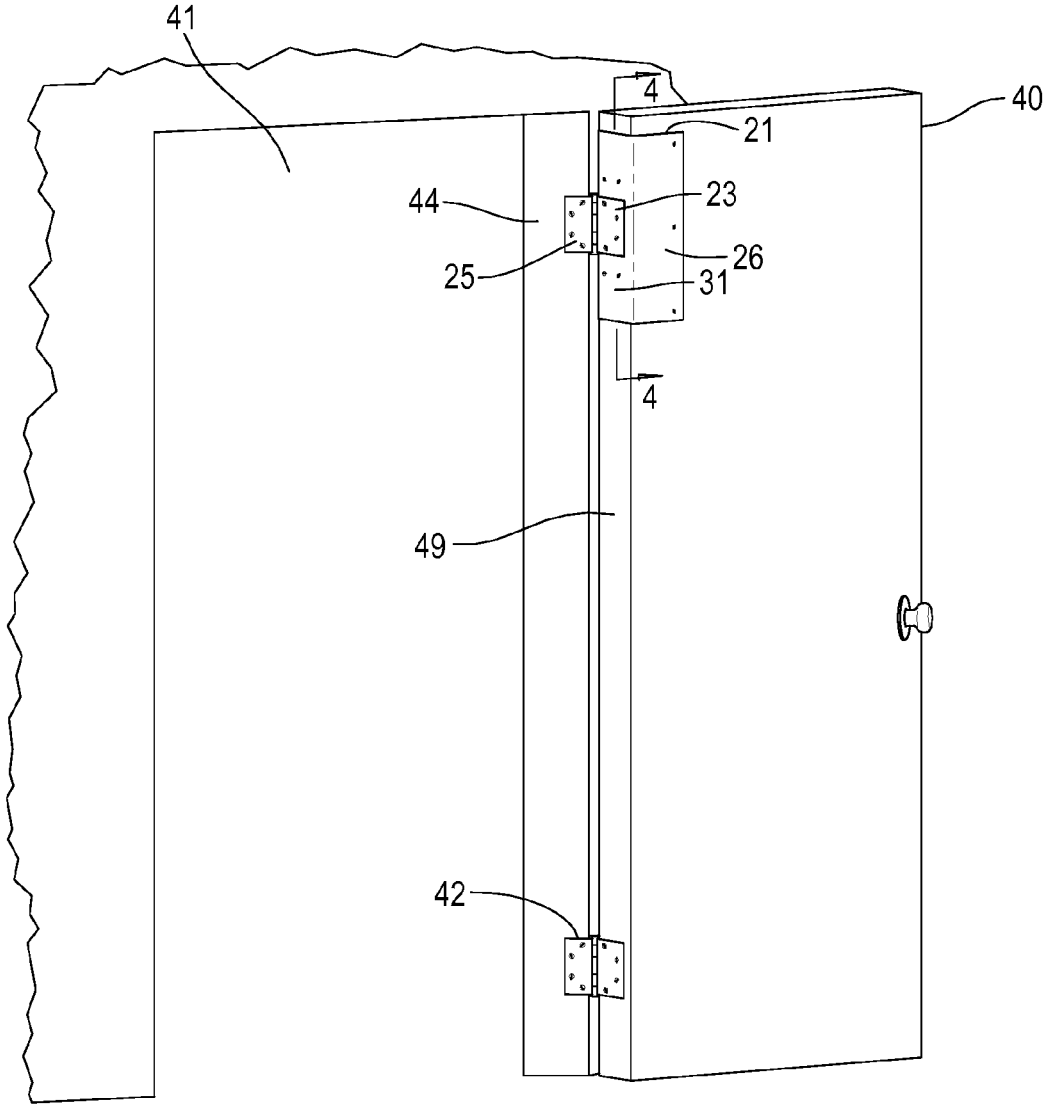
FIG. 3 is the same view as FIG. 1 only showing the damaged hinge portion of the door repaired with the kit.

Kit 20 is shown in FIG. 2 having various components to allow a door having a damaged hinge area to be remounted to the hinge thereby securing the door to the door jamb. Kit 20 includes a U-shaped bracket 21 having a pair of parallel walls 26 and 27 integrally joined to a first wall, also referred to herein as an intermediate wall 31. A bracket first wall 27 and bracket second wall 26 are spaced apart forming a channel 32 into which the damaged edge portion 33 (FIG. 1) is located. In other words, bracket 21 is mounted to door 40 with the intermediate wall 31 extending over and parallel to surface 49 (FIG. 3) of the door edge. Conventional fastening devices extend through a plurality of holes 50 provided on walls 26 and 27 mounting the walls directly to the opposite sides of the door.

Wall 31 is intermediate the edge portions of walls 26 and 27 and is thereby mounted to the edge of the door and is positioned between the edge of the door and the door jamb 41 when the door is mounted to the door jamb. A hinge 22 (FIG. 2) has a pair of hinge plates 23 and 25 having adjacent edge portions hingedly connected together. Plate 23 is mounted to bracket 21 whereas hinge plate 25 is mounted to the door jamb.

Intermediate wall 31 is located between and perpendicularly arranged and integral with respect to the parallel walls 26 and 27. A portion of intermediate wall 31 is cutout forming an opening 60. Opening 60 extends through wall 27. Opening 60 extends across the width of intermediate wall 31 with the exception that the opening terminates prior to reaching wall 26 thereby forming a ledge 63 against which the edge 64 of hinge plate 23 rests. On the other hand, opening 60 extends across the width of the wall 31 and through wall 27 thereby not providing a ledge adjacent wall 27 similarly to ledge 63 provided for wall 26. The thickness of hinge plate 23 is equal to the depth of opening 60 extending through wall 27 thereby allowing the top surface 65 of hinge plate 23 to be flush and parallel with top surface 66 of intermediate wall 31.

Figure 4:
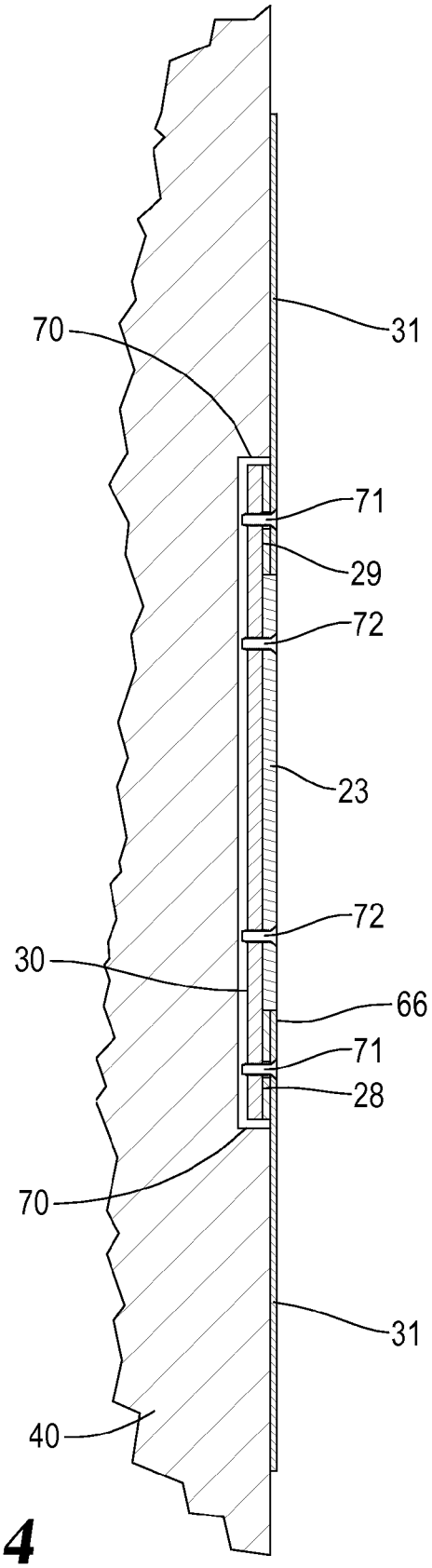
FIG. 4 is an enlarged cross-sectional view taken along the line 4-4 of FIG. 3 and viewed in the direction of the areas.

Referring to FIG. 4, a cross-sectional view of the U-shaped bracket is shown mounted to the damaged edge portion of door 40. Intermediate wall 31 is mounted by flat head machine screws 71 to a mounting wall 30 located within an indented portion 70 of door 40. Prior to attaching bracket 21 and other components to the door, the damaged area 33, which includes holes 48, (FIG. 1) is removed from the door by cutting an indent into the door to receive mounting plate 30, spacers 28 and 29, and hinge plate 23. Spacers 28 and 29 are positioned between intermediate wall 31 and mounting wall 30. Screws 71 extend freely through intermediate wall 31 and spacers 28 and 29 but are threadingly received by mounting wall 30. Additional flat head machine screws 72 extend through hinge plate 23 and mount the hinge plate to the mounting wall 30. Thus, machine screws 71 secure intermediate wall 31 to the mounting wall 30 whereas machine screws 72 secure hinge plate 23 to mounting wall 30. Indented portion 70 has sufficient depth to ensure contact between mounting wall 30 and hinge plate 23 while maintaining hinge plate surface 65 flush with the outwardly facing surface 66 of the intermediate wall 31. The thickness of spacers 28 and 29 is chosen such that the spacers are in contact with mounting wall 30 as well as intermediate wall 31 while further locating hinge plate outer surface 65 flush with intermediate wall outer surface 66. The intermediate wall 31 as well as walls 26 and 27 of bracket 21 are secured to the door by conventional fastening devices extending through holes 50 of walls 26 and 27 and are threadedly received by the door.

The intermediate wall 31 mountable to the edge of the door is positioned between the door edge and the door jamb when the door is mounted to the door jamb. The hinge mounting wall 30 mounted to the intermediate wall 31 is positioned between the intermediate wall and the door when bracket 21 is mounted to the door. Opening 60 receives hinge plate 23 and extends only through one of the parallel walls, namely wall 27 to allow hinge plate 23 to be flush with wall 31. The top surface of hinge plate 23 is flush with wall 31 when mounted thereto. Likewise, spacers 28 and 29 are mounted between the intermediate wall 31 and hinge mounting wall 30 to allow hinge plate 23 to be flush with the intermediate wall 31. Hinge plate 23 is positioned and mountable over the damaged area of surface 49 (FIG. 3) of the door to conceal the damaged area. Notably, bracket 21 has a length that is longer than the hinge plate 23 which is located midway on said bracket and midway between the opposite ends of wall 31.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for mounting a door having an edge with a damaged hinge area to a door jamb comprising:

a first wall mountable to an edge of a door and positionable between said edge of said door and a door jamb when said door is mounted to the door jamb;

a hinge mounting wall separate from said first wall and mountable thereto and positionable between said first wall and a damaged hinge area of said door;

spacers mounted between said first wall and said hinge mounting wall;

a hinge having a first hinge plate and a second hinge plate, said first hinge plate and said second hinge plate having hingedly connected together-said first wall having an opening into which said first hinge plate is positionable to be flush with said first wall;

first fastening devices to secure said first hinge plate to said hinge mounting wall;

second fastening devices to secure said hinge mounting wall to said first wall;

spaced apart and parallel walls mountable to opposite sides of said door, said first wall is located between and perpendicularly arranged and integral with respect to said parallel walls forming a bracket; and wherein:

said opening of said first wall extends only through one of said parallel walls forming a ledge to allow said first hinge plate to contact said ledge to be flush with said first wall when mounted thereto.

2. The device of claim 1, further comprising:

said spacers position said first hinge plate flush with said first wall; and wherein said first hinge plate is mountable over a damaged area of said door to conceal same, said second hinge plate is mountable to a door jamb.

3. The device of claim 2 wherein:

said bracket is longer than said first hinge plate which is located midway on said bracket.

4. The combination:

a door having a damaged edge:

a door frame having said door pivotally mounted thereto;

a bracket having a first wall and a second wall with an intermediate wall positioned therebetween with said bracket mounted to said damaged edge of said door, said intermediate wall having an opening which extends only through one of said first wall but not said second wall forming a ledge at said second wall;

fastening devices;

a mounting wall separate from but fastened to said intermediate wall of said bracket by said fastening devices;

a hinge having a first hinge plate positioned in said opening and a second hinge plate hingedly fastened together, said first hinge plate fastened to said mounting wall with said second hinge plate fastened to said door frame to pivotally mount the door thereto, said first hinge plate extending from said ledge across said opening positioning said hinge relative to said door;

spacers mounted between said intermediate wall and said mounting wall for adjusting said mounting wall relative to said intermediate wall;

and additional fastening devices extending through said bracket into said door for fixedly securing said bracket to said door, and further fastening devices extendable through said first hinge plate and said mounting wall securing said hinge to said door.

* * * * *